US005574543A

United States Patent [19]

Sakai et al.

[11] Patent Number: 5,574,543

[45] Date of Patent: Nov. 12, 1996

[54] IMAGE FORMING APPARATUS

[75] Inventors: Eiichi Sakai; Okushi Okuyama, both of Hachioji,, Japan

[73] Assignee: Konica Corporation, Japan

[21] Appl. No.: 301,331

[22] Filed: Sep. 6, 1994

[30] Foreign Application Priority Data

| | | | |
|---|---|---|---|
| Sep. 16, 1993 | [JP] | Japan | 5-230480 |
| Sep. 17, 1993 | [JP] | Japan | 5-231816 |
| Sep. 17, 1993 | [JP] | Japan | 5-231817 |
| Jan. 11, 1994 | [JP] | Japan | 6-001327 |

[51] Int. Cl.[6] ..... G03G 21/00

[52] U.S. Cl. ..... 399/59; 399/223

[58] Field of Search ..... 355/208, 210, 355/245, 246, 326 R, 327

[56] References Cited

U.S. PATENT DOCUMENTS

| | | | |
|---|---|---|---|
| 4,466,731 | 8/1984 | Champion et al. | 355/246 |
| 4,894,685 | 1/1990 | Shoji | 355/246 |
| 5,005,517 | 4/1991 | Fukui et al. | 355/246 X |
| 5,060,013 | 10/1991 | Spence | 355/208 |
| 5,124,788 | 6/1992 | Suboi et al. | 358/80 |
| 5,153,647 | 10/1992 | Barker et al. | 355/245 |
| 5,298,960 | 3/1994 | Fukuchi et al. | 355/326 R |
| 5,321,468 | 6/1994 | Nakane et al. | 355/208 |
| 5,400,120 | 3/1995 | Narazaki et al. | 355/208 |

OTHER PUBLICATIONS

Patent Abstracts of Japan, vol. 12, No. 354; Sep. 22, 1988 JPA-63-106,672.

Patent Abstracts of Japan, vol. 14, No. 468; Oct. 12, 1990 JPA-2-186,368.

*Primary Examiner*—Sandra L. Brase

*Attorney, Agent, or Firm*—Jordan B. Bierman; Bierman and Muserlian

[57] ABSTRACT

A patch image is formed on the photoreceptor under a patch image forming condition which is different from a recording image forming condition. The recording image forming condition is controlled by adjusting at least one of a charging device, a developing device and an electric bias in accordance with the density of the patch image.

8 Claims, 14 Drawing Sheets

TONER DETECTION CURVE

POINT A

POINT B

POINT C

POINT D

FIG. 4 (a)-1
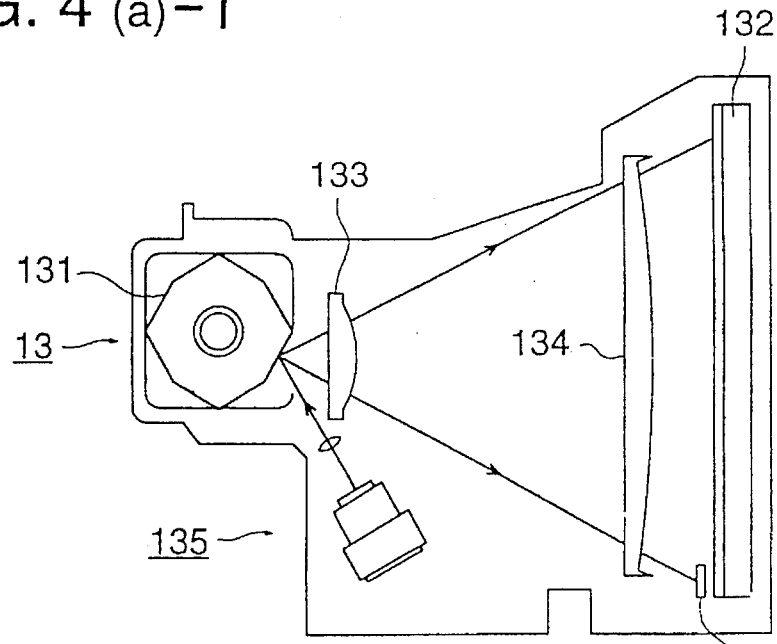
FIG. 4 (a)-2
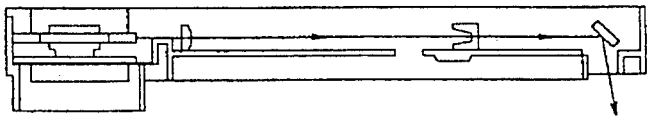
FIG. 4 (b)-1
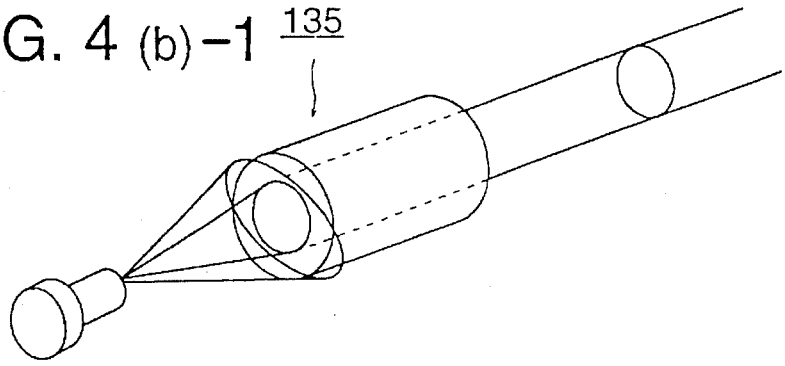
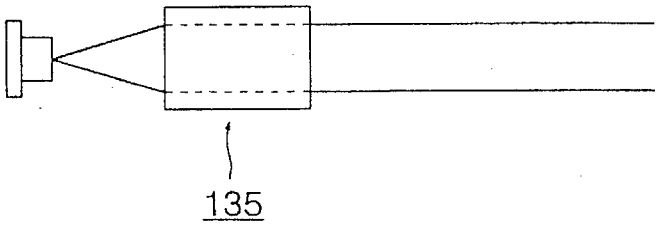
FIG. 4 (b)-2

IMAGE FORMING APPARATUS

BACKGROUND OF THE INVENTION

The present invention relates to an image forming apparatus for controlling image forming conditions by a density signal which is obtained by detecting a patch image. More particularly, the present invention relates to the control of image forming conditions at the time of color image formation.

In an image forming apparatus, the apparatus is provided with developing units in which developers are accommodated. A toner image is formed on an image carrier when reversal development etc. are conducted by the developing units. Then, the toner image is transferred onto a recording material and an image is recorded.

When a color image is formed, the apparatus is provided with four developing units in which each of yellow (Y), magenta (M), cyan.(C), and black (BK) developers are accommodated. When a mono-color toner image formed by the reversal development of each developing unit is superimposed on the image carrier, a color toner image is formed. This color toner image is transferred onto the recording material and a color image is recorded.

In this case, it greatly affects the quality of the image whether the image density of the image recorded on the image carrier is stably maintained or not in the case where a large number of sheets are copied.

Further, at the time of the color image formation, the color image is formed by superimposing a plurality of mono-color toner images. Accordingly, the reproducibility etc. of the color image are largely affected due to whether each mono-color toner image is developed into an image having well-balanced image density. Specifically, it is difficult to stabilize the secondary colors (red(R), green (G), and blue (B), etc.) which are made by superimposing the primary colors of Y, M and C.

Therefore, the image forming apparatus is provided with a control means for controlling the image density of the toner image.

As a control means for the image density of the toner image, the following means are widely known. First, a means in which a tablet-shaped patch image having a standard density corresponding to the toner image is formed on the image carrier, and image forming conditions are controlled by a density signal obtained by detecting the patch image (Japanese Patent Publication Open to Public Inspection No. 106,672/1988). Next, a means for controlling the number of revolution of the developing sleeve of the developing unit corresponding to the humidity in the apparatus (Japanese Patent Publication Open to Public Inspection No. 186,368/1990).

An optical detection means composed of a light emitting element and a light receiving element is used for density detection of the patch image. FIG. 1 shows the relationship of the output voltage of the optical detection means obtained by detecting the patch image with the toner adhesion amount onto an image forming body.

In FIG. 1, the optical detection means has a good detection sensitivity in the case of a low density or an intermediate density in which the toner adhesion amount is relatively small (Points A and B in FIG. 1). However, the detection sensitivity is largely lowered in the case of the density of a solid image or characters onto which the toner adhesion amount is large (points C and D In FIG. 1).

This is due to the following. In the cases of FIG. 2(*a*) and FIG. 2(*b*), the difference of toner adhesion can be satisfactorily detected. On the contrary, as shown in FIG. 2(*c*) and FIG. 2(*d*), in the case where toner adheres onto all the surface of the image carrier, and further toners superimposed thereon, the difference can not be detected optically because the surface of the image carrier has already been covered by toners. (Conditions of toner adhesion at points A to D in FIG. 1 are shown in FIGS. 2(*a*) to 2(*d*).)

Accordingly, conventionally the patch image corresponding to the high density solid image or characters is not made for the purpose of density detection, and the low density or intermediate density patch image is made to detect the density.

However, the following necessity is recognized. It is necessary to accurately detect how the high density toner image which is required for the solid image or characters is developed, and to control it for the purpose in which the image density is stably maintained even in the case of a large amount of copying, or in which Y, M, C and BK are each developed with well-balanced image density at the time of color image formation.

Further, there is a problem in that the output of the optical detection means differs from that of the same density patch image due to a stain or a flaw of the image carrier surface caused by extended use.

Further, there is a problem in that the outputs of the optical detecting means are not outputted in a balance with each other due to the difference between respective reflection densities of color toners at the time of color image formation.

SUMMARY OF THE INVENTION

The first object of the present invention is to form a patch image at a potential at which a high density toner image which is required for the solid image or characters is formed on an image carrier (at the lowest potential VL in the case of reversal development), and to accurately control the image density by a density signal which is obtained by detecting the patch image.

The second object of the present invention is to improve a density detection method of the patch image and to satisfactorily control the image density in spite of a stain or a flaw on the image carrier surface due to extended use.

The third object of the present invention is to control the image density so that mono-color toner images are respectively developed into well-balanced image densities in view of the composition of the color image corresponding to the difference between reflection densities of color toners in the color image forming apparatus.

The first object can be accomplished when the patch image is made on the image carrier under developing conditions that are different from normal conditions in the image forming apparatus by which the patch image formed on the image carrier is detected by the optical detection means so that the image density is controlled.

In more detail, the developing conditions which are different from the normal developing conditions means that the developing sleeve of the developing unit, developing bias voltage, charging voltage or the like are set in conditions which are different from those at the time of normal image formation and that the patch image is formed at a potential at which the high density toner image which are required for the solid image or characters is formed on the image carrier (at the lowest potential level VL in the case of reversal development).

The second object can be accomplished by appropriately compensating the output signal of the optical detection means.

The third object can be accomplished by switching the conditions of patch image formation of each color corresponding to colors of each color toner. Further, the third object can be also accomplished by appropriately compensating the output signal of the optical detection means corresponding to colors of each color toner.

BRIEF DESCRIPTION OF THE DRAWINGS

FIGS. 4*a*-1, 4*a*-2, 4*b*-1 and 4*b*-2 are views showing the structure of an image exposure means.

DETAILED DESCRIPTION OF THE INVENTION

Figure 1:
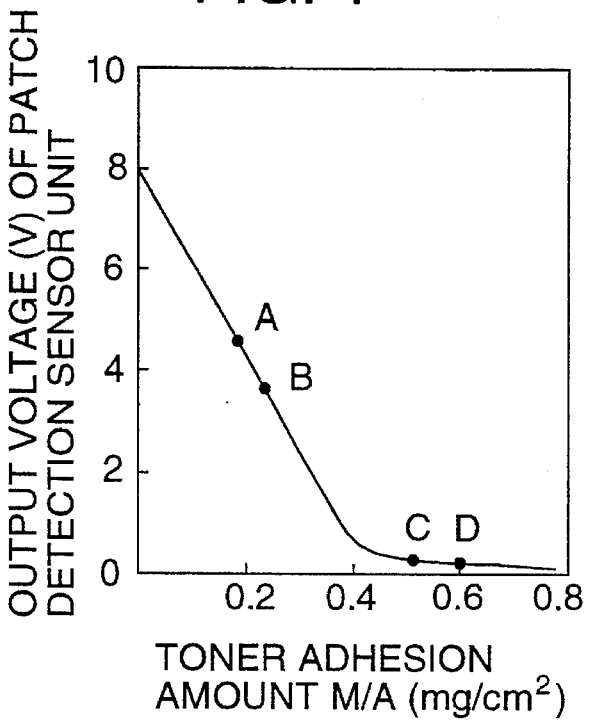
FIG. 1 is a graph showing the relationship between the output voltage of the patch detection unit and a toner adhesion amount.
Figure 2:
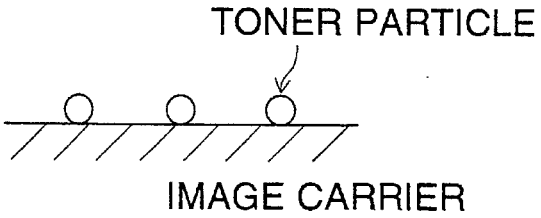
FIG.2(*a*) through 2(*d*) are views of samples showing toner adhesion conditions onto the image carrier.
Figure 2:
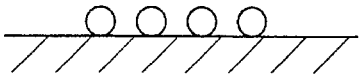
Figure 2:
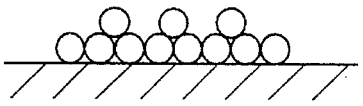
Figure 2:
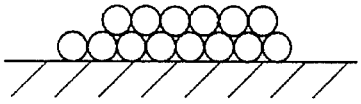
Figure 3:
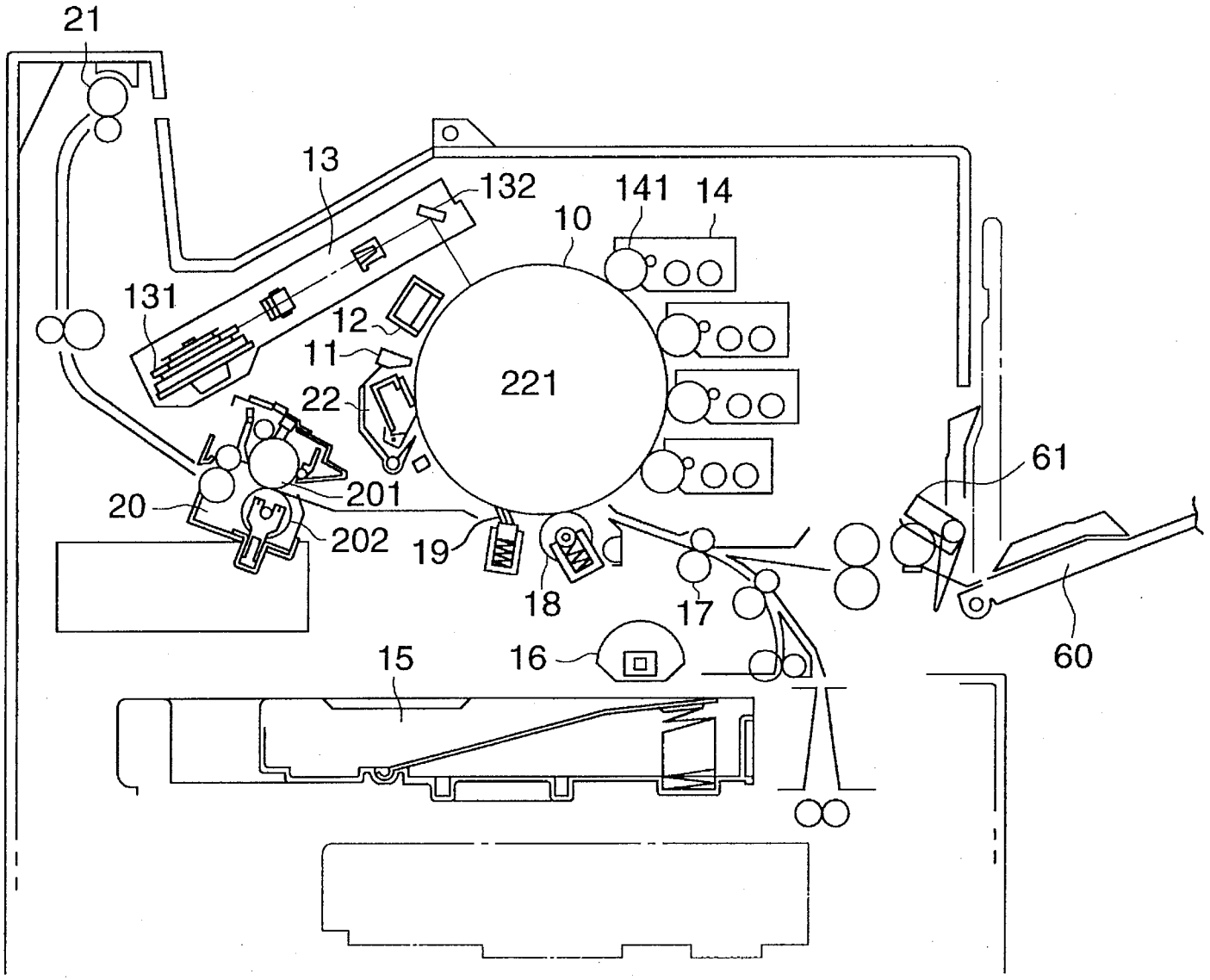
FIG. 3 is a view showing the structure of a color image forming apparatus of the present invention.

Referring to FIG. 3, the structure and the mode of operation of a color image forming apparatus of the present invention will be described below.

In FIG. 3, numeral 10 is a photoreceptor drum which is an image carrier and on which an OPC photoreceptor is coated. The photoreceptor drum is grounded and rotated clockwise. Numeral 12 is a scorotron charger by which the uniformly charging voltage $V_H$ is impressed upon the peripheral surface of the photoreceptor drum 10 by corona discharge using a grid having a potential $V_G$ and a corona discharging wire. Prior to charging by this scotorton charger 12, the peripheral surface of the photoreceptor is discharged by exposing the surface by a PLC 11 using a light emitting diode etc. in order to erase the hysteresis of the photoreceptor.

Image exposure according to the image signal is conducted by an image exposing means 13 after the photoreceptor has been uniformly charged. The image exposing means 13 scans a document when a laser diode, not shown, is used as a light emitting source and an optical path of a laser beam is bent by a reflection mirror 132 through a rotating polygonal mirror 131, an fθ lens, etc. A latent image is formed by rotation of the photoreceptor drum 10 (subsidiary scanning). In this example, a character section is exposed and a reversal latent image is formed so that the potential voltage of the character section is lower ($V_L$) than that of other sections.

Developing units 14, in which developers composed of toners of yellow (Y), magenta (M), cyan (C) and black (K) and a carrier are respectively accommodated, are provided around the photoreceptor drum 10. Initially, the first color development is conducted by a developing sleeve 141 in which a magnet is accommodated and which is rotated while maintaining the developer. The developers are made of a carrier in which ferrite is used as a core and insulating resin is coated around the core, and toners in which polyester is used as a main material, and pigments corresponding to colors, charge control agent, silica, titanium oxide, etc. are added to the main material. Developers are conveyed to a developing area after the developer layer thickness on the developing sleeve 141 has been regulated to 100 to 600 μm by a layer forming means.

A gap between the developing sleeve 141 and the photoreceptor drum 10 in the developing area is 0.2 to 1.0 mm which is larger than the developer layer thickness. An AC bias voltage of $V_{AC}$ and a DC bias voltage of $V_{DC}$ are superimposed and impressed upon the gap. Because the polarity of $V_{DC}$, $V_H$ and the toner charging potential are the same, the toner, to which a chance to separate from the carrier is given by a $V_{AC}$, does not adhere to a $V_H$ portion, the potential of which is higher than $V_{DC}$, but adheres to a $V_V$ portion, the potential of which is lower than $V_{DC}$, and the latent image is visualized (reversal development).

The image forming apparatus enters into the second color image forming process after the first color visualization, and the uniformly charging operation is conducted again by a scorotron charger 12. Then, the latent image according to the second color image data is formed by the image exposing means 13. A discharging operation by the PCL 11 which has been conducted in the first color image forming process is not conducted because toners adhered to the first color image section are scattered due to sudden lowering of the surrounding potential.

In the photoreceptor which has again the potential of $V_H$ over the entire peripheral surface of the photoreceptor drum 10, the latent image which is the same as the first color latent image is formed on a portion on which the first color image does not exist, and is developed. When a portion on which the first color image exists is developed again, the latent image having the potential voltage of $V_M'$ is formed by light shielding by the first color adhered toner and by a charge of toner itself. Then, the latent image is developed corresponding to the voltage difference between $V_{DC}$ and $V_M'$. When the first color development is conducted after the latent image having the potential voltage of $V_L$ has been formed on the portion on which the first color image and the second color image are superimposed, the balance of the first color with the second color are lost. Accordingly, there is an occasional case where the first color exposure amount is decreased and an intermediate potential voltage is set at $V_H>V_M>V_L$.

The image forming apparatus enters into the third and the fourth image forming processes in the same way as the second color image forming process. Then the four color image is formed on the peripheral surface of the photoreceptor drum 10.

A recording sheet conveyed from a sheet feed cassette 15 through a semi-circular roller 16 is temporarily stopped and fed to a transfer area by the rotation of a sheet feed roller 17 in timed relation with the transfer unit.

The image forming apparatus shown in FIG. 3 can also feed the recording sheet by hand-feeding, other than the sheet feeding by an automatic sheet feeding mechanism. The recording sheet P fed by a hand-feed tray 60 is conveyed by the rotation of a pick-up roller 61 and fed to the transfer area through the same sheet feeding process as that by the sheet feed cassette 15.

In the transfer area, the transfer roller 18 contacts the peripheral surface of the photoreceptor drum 10 with pressure synchronized with the timing of transfer. The recording sheet is sandwiched and images of multi-colors are transferred onto the sheet all at once.

Next, the recording sheet is discharged by a separation brush 19 which is pressure-contacted with the photoreceptor drum at almost the same time. The recording sheet is separated from the peripheral surface of the photoreceptor drum 10 and conveyed to a fixing unit 20. The recording sheet is delivered to the outside of the apparatus through the delivery roller 21 after toner has been fused by heat from a thermal roller 201 and pressure from a pressure-contact roller 202. The transfer roller 18 and the separation brush 19 are withdrawn and separated from the peripheral surface of the photoreceptor drum 10 after the recording sheet has passed, and are ready for the next toner image formation.

The residual toner on the photoreceptor drum 10 from which the recording sheet has been separated is removed for cleaning by pressure-contact from a blade 221 of the cleaning unit 22. The photoreceptor drum 10 is discharged again by the PCL 11 and charged by the charger 12, and is ready for the next image forming process. The blade 221 is moved immediately after cleaning of the photoreceptor surface and withdrawn from the peripheral surface of the photoreceptor drum 10.

Characteristics of the functions and performance of units by which the image forming section of the apparatus is structured, will be explained below.

The OPC photoreceptor on the peripheral surface of the photoreceptor drum 10 is uniformly charged by the scorotron charger 12 when the photoreceptor drum 10 is stably rotated. The grid potential voltage is controlled at the time of charging so that the charging potential is stabilized. Specifications and charging conditions of the photoreceptor are set as in the following example.

Photoreceptor: a negatively-charged type OPC whose diameter is ϕ120 and line speed 100 mm/sec Charging conditions: a charging wire: a platinum wire (clad or alloy) is preferably used. $V_H$–850 V, $V_L$–50 V (Image exposure)

FIG. 4(*a*) is a plan and side view of the layout of the image exposure means 13. FIG. 4(*b*) is a view explaining the semiconductor laser unit 135 used for the image exposure means 13.

After the OPC photoreceptor on the peripheral surface of the photoreceptor drum 10 has been negatively charged by the charger 12, the photoreceptor is exposed by light emission of the semiconductor laser unit 135 of the exposure means 13 and the electrostatic latent image is formed.

Image data sent from a formatter for decoding a printer command is sent to a laser diode (LD) modulation circuit. When the LD of the semiconductor laser unit 135 emits the laser beam by a modulated image signal, the light beam is projected onto a polygonal mirror 131 through a mirror 132 when scanning lines are synchronized with each other by a beam index.

The polygonal mirror 131 reflects the light beam for scanning by a polygonal body thereof. The scanning light beam exposes the photoreceptor through the reflection mirror 132 and the primary scanning is conducted on the photoreceptor. The electrostatic latent image is formed after the shape of the beam has been corrected by an fθ lens 133 and a cylindrical lens 134.

The beam diameter of the laser beam is narrowed down to 7 PDI equivalent by the optical system. Accordingly, it is necessary that the particle size of toner is small in order to obtain a high quality image. In this example, 8μ sized toner is used for each color.

Here, the character quality of black is necessary for the user and a small sized toner (7 to 11 μm) is preferable for black toner.

The optical system used for the image exposure is structured as follows.

A polygonal mirror: 6 sides, the number of revolutions: 23600 rpm, air bearing is adopted.

The focal length of lens: f=140 mm.

Dot clock: 20 MHz

Beam diameter: Approx. 60×80 μm (Development)

Figure 5:
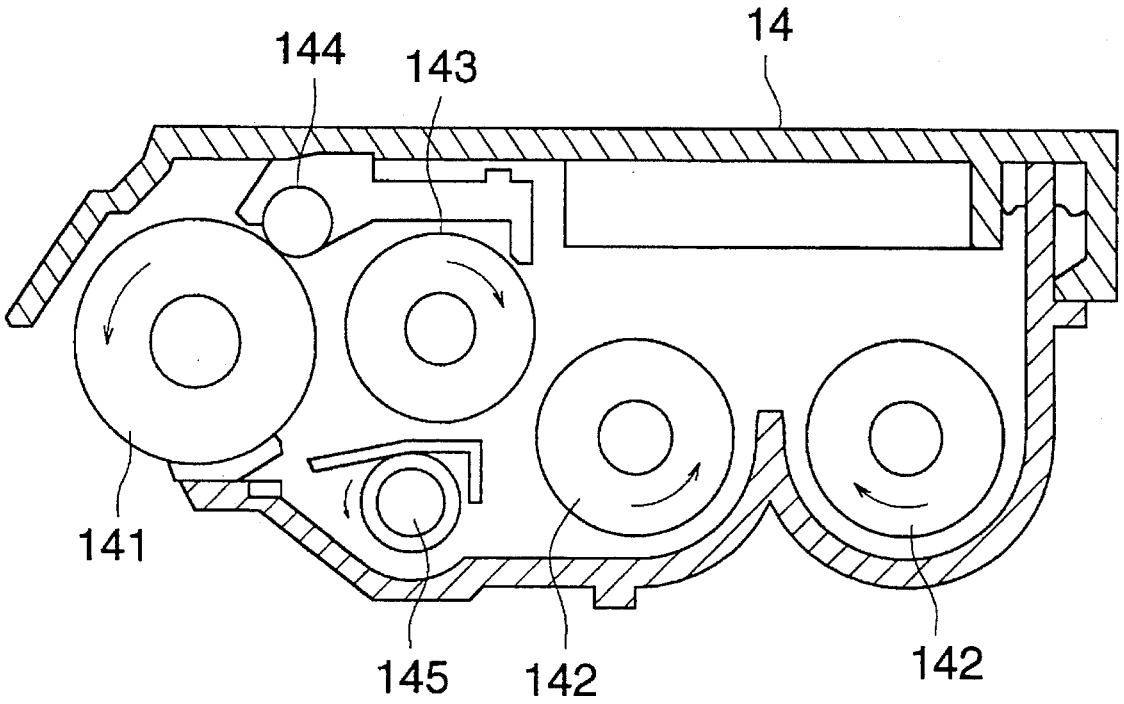
FIG. 5 is a view showing the structure of a developing unit.

FIG. 5 shows the structure of the developing unit 14. Toner supplied from a toner box, not shown, is dropped to the right end portion of the of the developing unit, stirred with carriers by a pair of stirring screws 142 which are rotated respectively in counter directions, and is set to be charged with a predetermined charge amount (Q/M).

Toner is supplied from a device provided in the developing unit and controlled so that the ratio of toner and carrier is at a predetermined value. Alternatively, another method can be used.

The stirred two component developer is conveyed to the developing sleeve 141 through a feed roller 143. The thickness of the developer layer is controlled to be thin by the layer thickness regulating member 144. Next, the developer is conveyed to the developing area of the photoreceptor drum 10, and reversal-developmemt of an electrostatic latent image is conducted according to the following developing conditions.

Development gap: 0.5 mm

Conveyance amount of toner: 20 to 30 mg/cm$^2$

Developing bias voltage (AC): 2 KV, 8 KHz

Developing bias voltage (DC): −750 V

Direction of rotation of the developing sleeve: Normal direction with respect to the photoreceptor drum Image density adjustment of the present invention will be described below.

Initially, referring to FIG. 6(*a*) and FIG. 6(*b*), the outline of the image density adjustment will be explained below.

A control circuit 31 controls the image exposure means 13, a grid voltage power source, a developing sleeve control circuit 34, a developing bias power source 35, etc., and forms 4 patch images P corresponding to each color toner on the photoreceptor drum 10.

Figure 6:
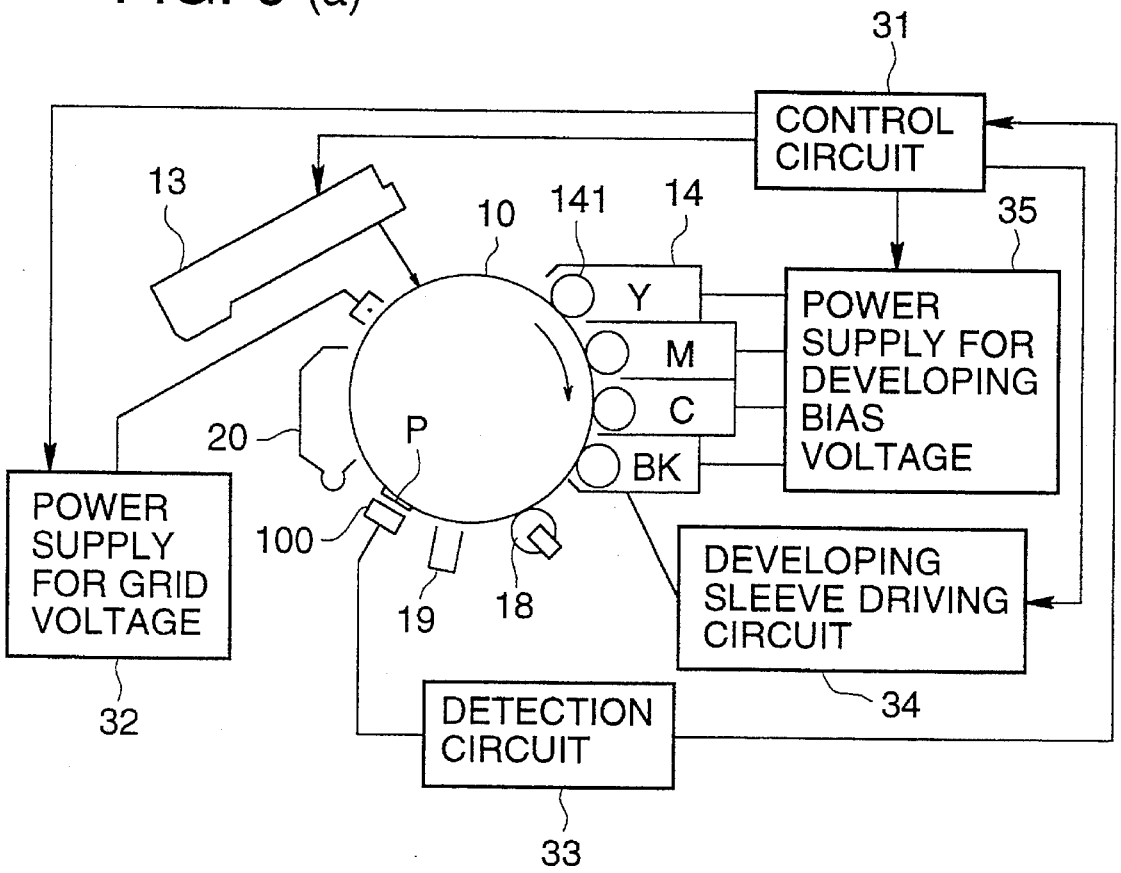
FIGS. 6(*a*) and 6(*b*) are views explaining patch image detection and a signal processing route thereof.
Figure 6:
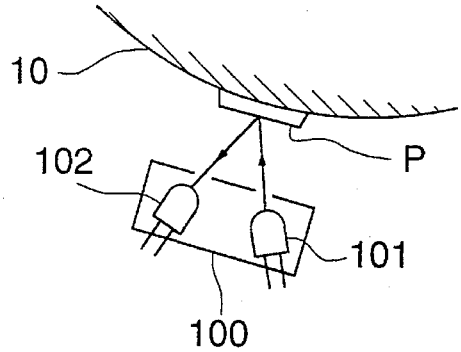

A reflection ratio, that is, the image density of the patch image P formed for each color is detected by a patch detection unit 100 which is placed at the upstream side of the cleaning unit 20 in the direction of the rotation of the photoreceptor drum 10 as shown in FIG. 6(*a*).

As shown in FIG. 6(*b*), the patch detection unit 100 is made up of a light emitting section 101 composed of an LED, and a light receiving section 102 composed of a photo-transistor. The detection unit 100 detects the reflection ratio of the patch image P, which is formed for each color, corresponding to the rotation of the photoreceptor drum 10 and sends the output signal corresponding to reflection ratio to the detection circuit 33.

Figure 10:
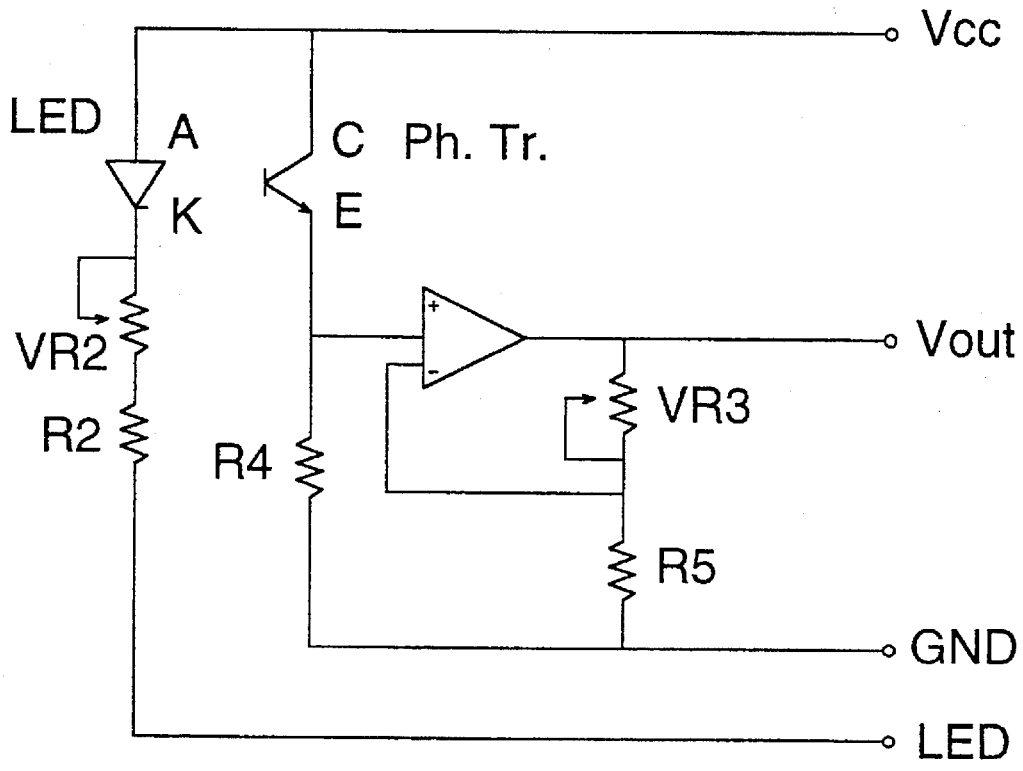
FIG. 10 is an example of the structure of the circuit of the patch detection unit.

An example of the circuit structure of the detection circuit 33 is shown in. FIG. 10. Here, Vout is an output voltage.

Although an example of the circuit structure of the patch detection unit 100 is shown above, four patch detection units may be provided corresponding to respective patch images of yellow (Y), magenta (M), cyan (C) and black (BK). Further, all the density of yellow (Y), magenta (M), cyan (C) and black (BK) may be detected by one patch detection unit.

The detection circuit 33 outputs the voltage signal to the control circuit 31 after the output signal corresponding to the reflection ratio of patch image which has been detected by the patch detection unit 100 has been converted into the voltage.

The control circuit 31 adjusts the grid voltage power source 32, the developing sleeve driving circuit 34 or developing bias voltage power source 35, and controls them so that the toner adhesion amount to the patch image P will be a predetermined value. By the control described above, the toner adhesion amount of the toner image which is formed on the photoreceptor drum 10 according to the image signal is controlled so as to be constant.

As an example of the methods by which the toner adhesion amount of the patch image P is controlled so as to be a predetermined value, the case in which the peripheral speed of the developing sleeve 141 in the developing unit 14 is adjusted will be explained below.

When the developing bias voltage and the grid voltage are also controlled corresponding to-the output voltage of the detection circuit 33 in the same manner as the control of the peripheral speed, the toner adhesion amount of the patch image P can be controlled so as to be a predetermined value.

Figure 7:
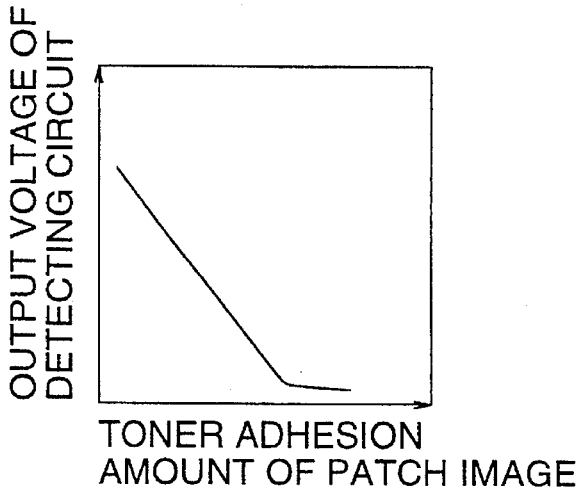
FIGS. 7(*a*), 7(*b*) and 7(*c*) are graphs showing the relationships between the toner adhesion amount, the peripheral speed of the developing sleeve and the output voltage of the patch detection unit.
Figure 7:
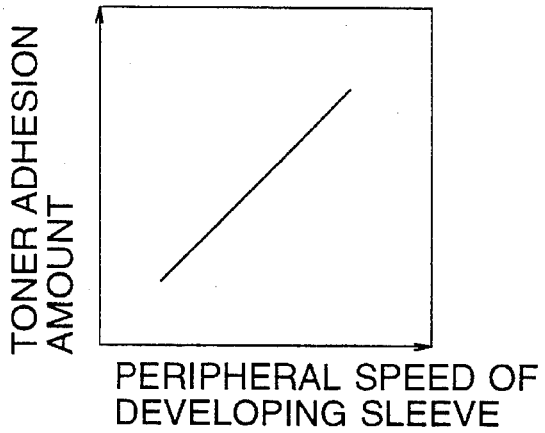
Figure 7:
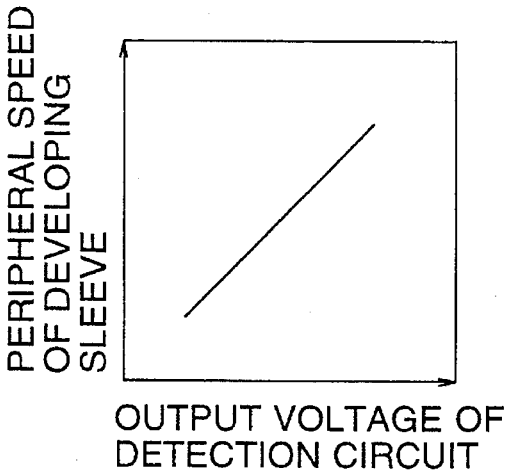

The relationship of the output voltage of the detection circuit 33 with the toner adhesion amount of the patch image P is shown in FIG. 7(*a*).

Concerning the toner adhesion amount to an area to be controlled, the output voltage which is decreased approximately linearly with respect to the toner adhesion amount is obtained as shown in the drawing.

On the other hand, the adhesion amount of the patch image P is proportional to the peripheral speed of the developing sleeve 141 in the developing unit 14 as shown in FIG. 7(*b*). Accordingly, as shown in FIG. 7(*c*), when the peripheral speed of the developing sleeve 141 is changed in proportion to the output voltage of the detection circuit 33, the toner adhesion amount of the patch image P can be controlled so as to be a predetermined value.

When the developing sleeve driving circuit 34 is controlled by the control circuit 31 so that the peripheral speed of the developing sleeve 141 is adjusted, the toner adhesion amount of the patch image P is controlled so as to be a predetermined value, and as a result, the toner adhesion amount of the toner image formed according to the image signal is controlled so as to be constant.

Accordingly, the accurate control of the image density of the toner image according to the image signal can be realized.

A specific control method is shown below.

The patch image P is structured as follows. The patch image P is formed in a comparatively short interval, for example, for a small amount of prints, 3 or 4 sheets; the image density is minutely adjusted according to the detection signal of the image density of the patch image P for every interval. The image density is maintained approximately to the reference level when the detection and adjustment operations are frequently repeated.

Figure 8:
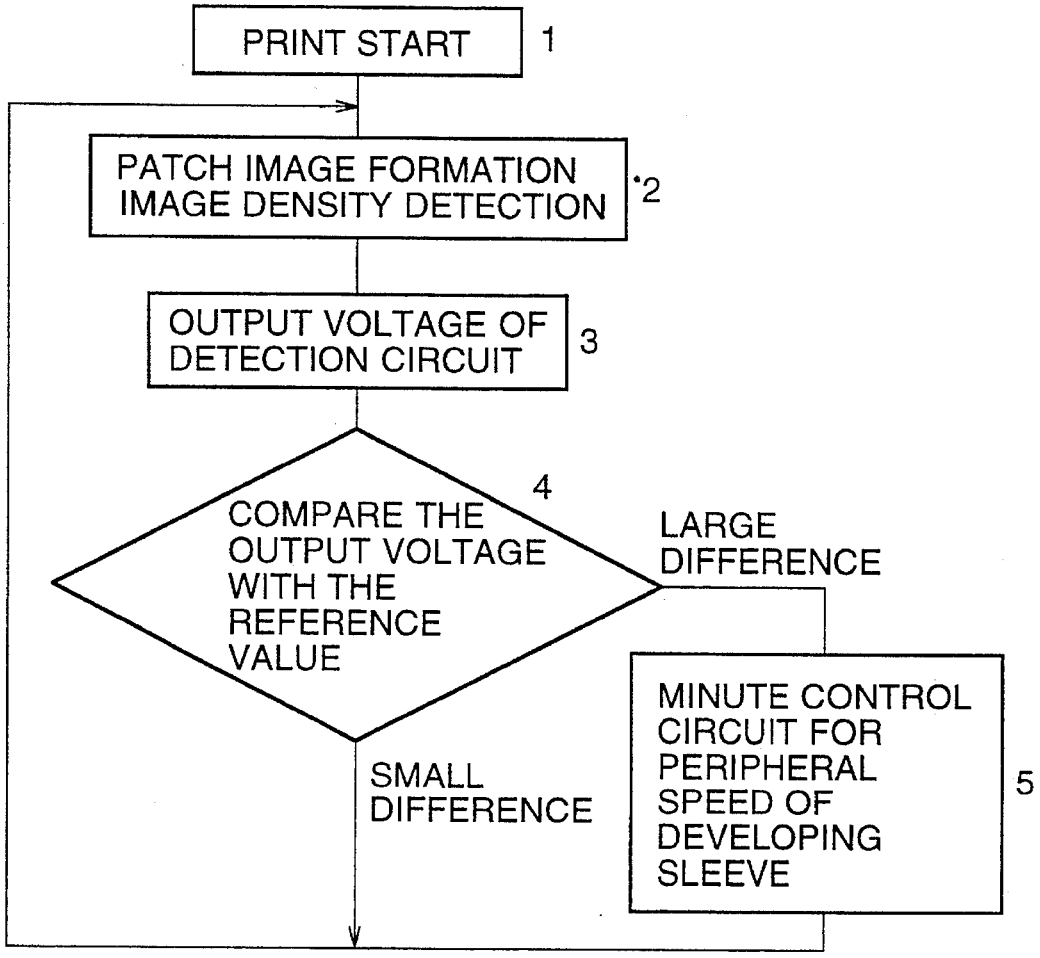
FIG. 8 shows a flow chart for controlling the peripheral speed of the developing sleeve.

Referring to a flow chart shown in FIG. 8, the image density adjusting process will be explained below. When printing operation starts (1), the patch image P is formed, and the image density is detected by the patch detection unit 100 in the same manner as the first example (2). The detection signal is converted into an output voltage and outputted from the detection unit (3).

This output voltage is compared with the reference value of the oputput voltage in the case of standard density (4). When the difference between both output voltages is smaller than a predetermined value, the image density is not adjusted. When the difference is larger than a predetermined value, the image adjustment signal is outputted to the control circuit so that the peripheral speed of the developing sleeve is minutely controlled.

Figure 9:
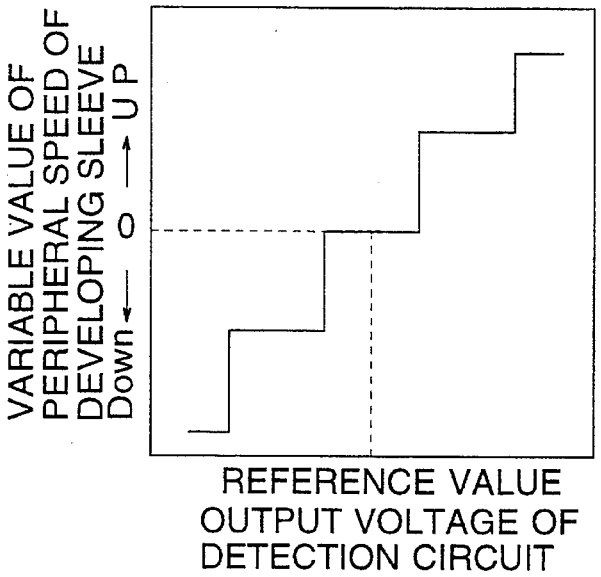
FIG. 9 is an example of a program for controlling the peripheral speed of the developing sleeve.

The control circuit, by which the minute amount of the image density is controlled, has a program by which the peripheral speed of the developing sleeve can be changed stepwise with respect to the output voltage from the detection circuit as shown in FIG. 9. When the detection adjustment signal is inputted into the control circuit, the number of revolutions of the developing sleeve is controlled so that the peripheral speed of the developing sleeve 141 steps up or down in several steps according to the foregoing program. That is, when the image density of the patch image P is small and the output voltage is larger than the reference value, the image density is adjusted by stepping up the peripheral speed of the developing sleeve 141. A feed back is conducted by repeating this operation and the image density is adjusted so that the output voltage from the detection circuit can always approach the foregoing reference value.

Next, the case where the patch image is formed under developing conditions which are different from those at the time of normal image formation will be explained below.

In this example, the latent image, the potential voltage $V_L$ of which is −50 V, should be formed on the photoreceptor drum 10 by the laser power of 0.4 μJ/cm$^2$ in order to form the high density toner image (amount of toner adhesion M/A (mg/cm$^2$)) on the photoreceptor drum 10 which is required for a solid image and characters.

Figure 15:
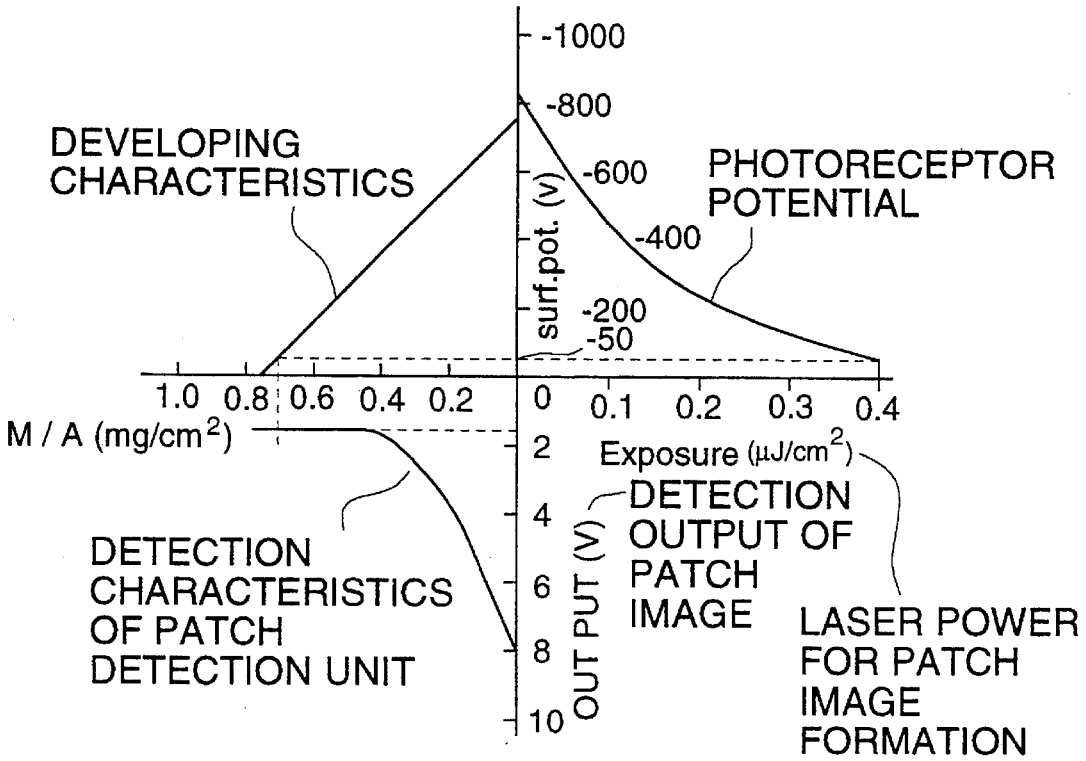
FIGS. 15(*a*) and 15(*b*) are graphs showing developing characteristics of the patch image.
Figure 15:
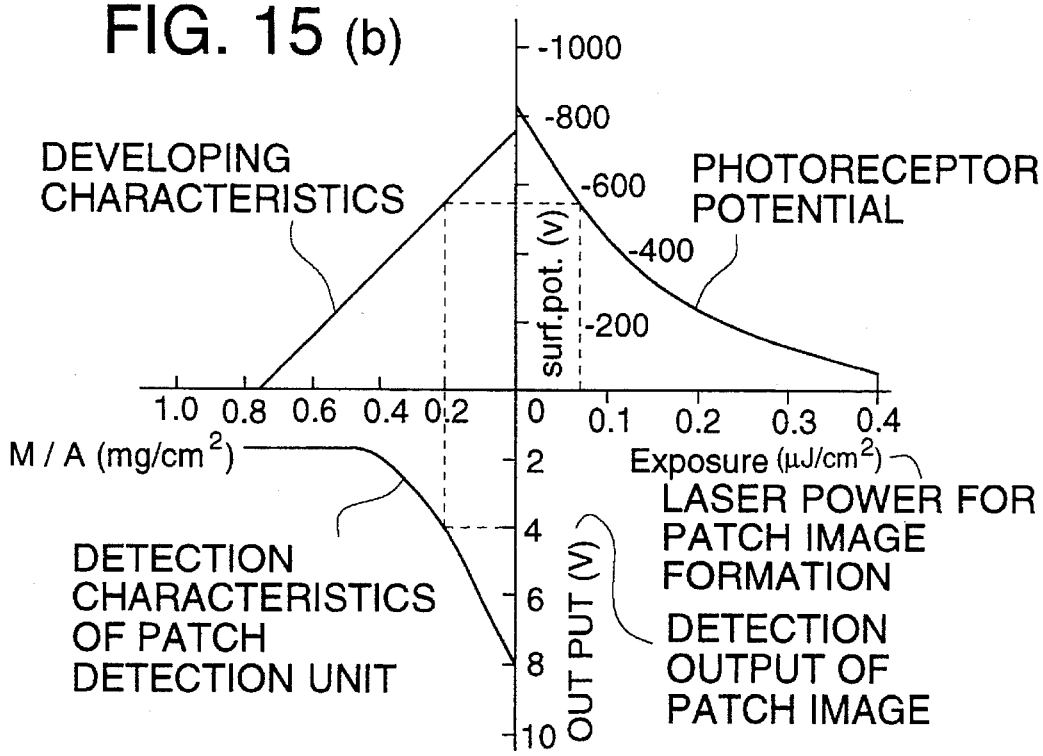

However, even when the latent image, the potential voltage $V_L$ of which is −50 V, is formed on the photoreceptor drum 10 and the patch image to which a large amount of toner of 0.7 mg/cm$^2$ is adhered is formed as shown in FIG. 15(*a*), the patch image is detected with the voltage which is lower than 2 V in an area in which the detection sensitivity of the patch detection unit 100 is low and the detection accuracy is extremely low.

In view of the above, in order to detect the patch image with the voltage of approximately 4 V in the area in which the detection sensitivity of the patch detection unit 100 is high, it is necessary to form the patch image, to which the toner of 0.2 mg/cm$^2$ is adhered, on the photoreceptor drum 10 by the laser power of 0.07 μJ/cm$^2$ as shown in FIG. 15(*b*).

However, due to the means described above, it can be judged what kind of toner image is formed on the photoreceptor drum 10 when the laser power (0.4 μJ/cm$^2$) is used to form the high density toner image, which is required for the solid image and characters and which should be most securely detected, on the photoreceptor drum 10.

Accordingly, image forming conditions which are different from normal image forming conditions are adopted in this example so that the patch image is formed in the area in which the detection sensitivity of the patch detection unit 100 is high, even when the laser power (0.4 μJ/cm$^2$) is used in order to form the high density toner image, which is required for a solid image and characters, on the photoreceptor drum 10.

Figure 16:
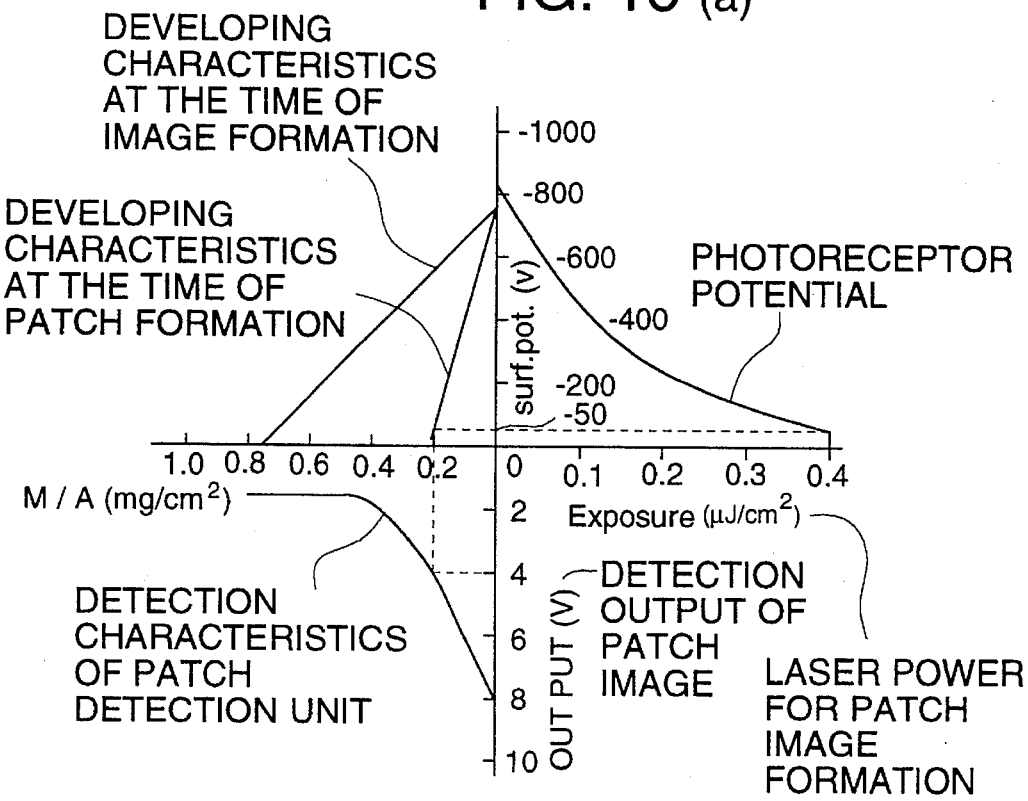
FIGS. 16(*a*), 16(*b*) and 16(*c*) are graphs showing developing characteristics of the patch image of the present invention.
Figure 16:
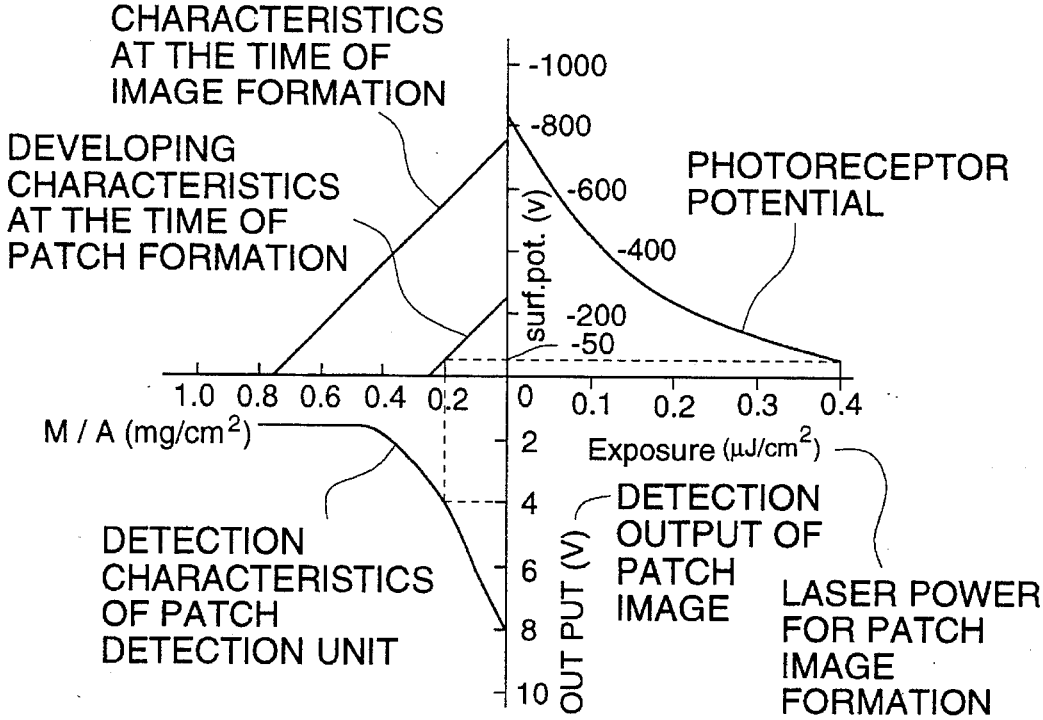
Figure 16:
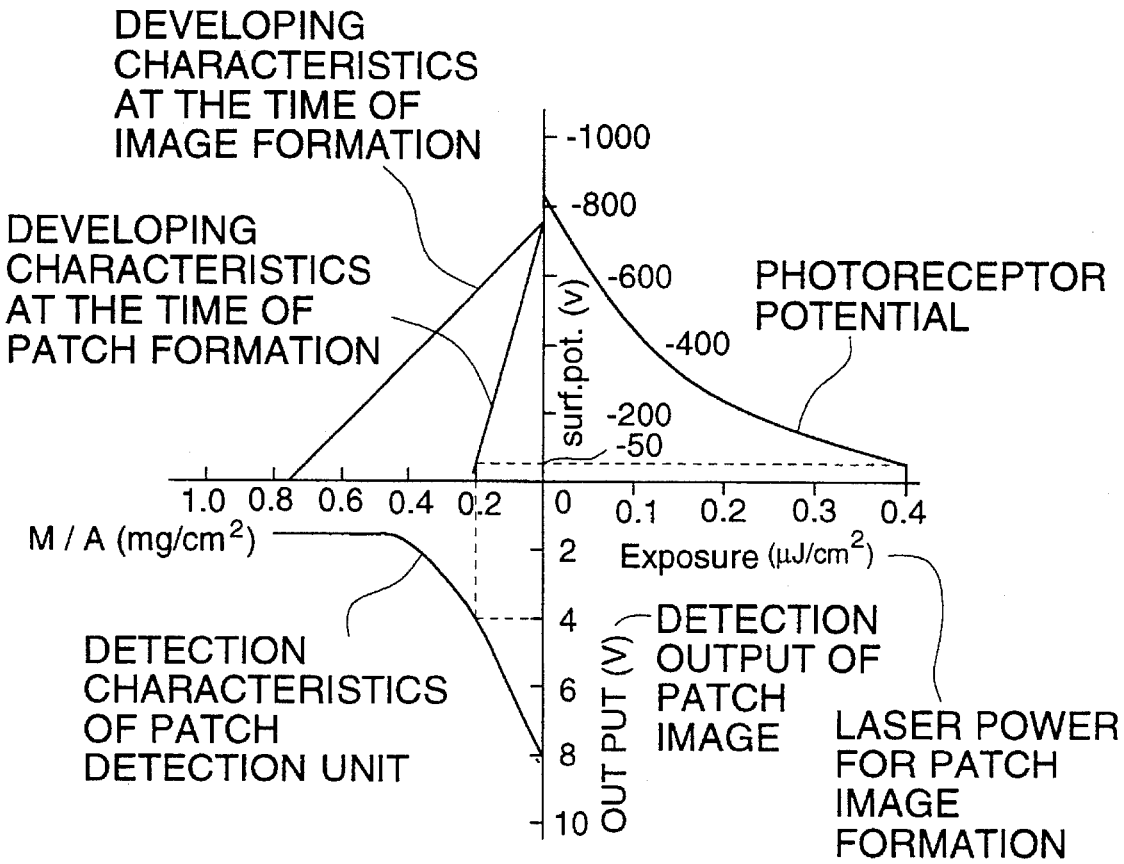

FIG. 16(*a*) shows the first example by which image forming conditions are switched. In this example, the peripheral speed of the developing sleeve 141 is lowered from 280 rpm at the time of normal image formation (fixed) to 80 rpm (fixed), and the patch images are formed respectively for yellow (Y), magenta (M), cyan (C) and black (BK).

When the peripheral speed of the sleeve is lowered, developing characteristics at the time of patch image formation as shown in FIG. 16(*a*) can be obtained.

By the means described above, when the laser power (0.4 μJ/cm$^2$) is used in order to form the high density toner image, which is required for a solid image and characters, on the photoreceptor drum 10, the latent image having the potential voltage $V_L$ of −50 V is formed on the photoreceptor drum 10. The patch image to which toner of 0.2 mg/cm$^2$ is adhered is formed and the area in which the detection sensitivity of the patch detection unit 100 is high (the output voltage of approximately 4 V) is formed.

Under the above conditions, the following operations are conducted. The densities of respective patch images for yellow (Y), magenta (M), cyan (C) and black (BK) are detected. The control circuit 31 in FIG. 6(*a*) controls the grid voltage power source 32 and adjusts the charging voltage corresponding to the output voltage of the patch detection unit 100 so that the toner adhesion amount of the patch image can be a predetermined value, independently of variations of characteristics of the photoreceptor drum and variations of developing characteristics. After the charging voltage adjustment, the peripheral speed of the sleeve is restored to 280 rpm at the time of toner image formation by the image signal.

Since there is proportional relationship between the peripheral speed of the sleeve and the toner adhesion amount, the toner adhesion amount of the toner image can be controlled to be constant at the time of toner image formation by the image signal as a result of the above control.

FIG. 16(*b*) shows the second example in which image forming conditions are switched. In this example, the developing bias voltage (DC) is lowered from −750 V at the time of normal image formation to 250 V and respective patch images for yellow (Y), magenta (M), cyan (C) and black (BK) are formed.

When the developing bias voltage is lowered, developing characteristics at the time of patch image formation can be obtained as shown in FIG. 16(*b*).

By the means described above, when the laser power (0.4 μJ/cm$^2$) is used in order to form the high density toner image, which is required for a solid image and characters, on the photoreceptor drum 10, the latent image having the potential voltage $V_L$ of −50 V is formed on the photoreceptor drum 10. The patch image to which toner of 0.2 mg/cm$^2$ is adhered is formed and the area in which the detection sensitivity of the patch detection unit 100 is high (the output voltage of approximately 4 V) is formed.

Under the above-described conditions, the following operations are conducted. The densities of respective patch images for yellow (Y), magenta (M), cyan (C) and black (BK) are detected, and the control circuit 31 in FIG. 6(*a*) controls the grid voltage power source 32 and adjusts the charging voltage corresponding to the output voltage of the patch detection unit 100 so that the toner adhesion amount of the patch image can be a predetermined value, independently of variations of the characteristics of the photoreceptor drum and variations of developing characteristics. After the charging voltage adjustment, the developing bias voltage is restored to −750 V at the time of toner image formation by the image signal.

Since there is a proportional relationship between the developing potential voltage ($V_L$−$V_{DC}$) and the toner adhesion amount, the toner adhesion amount of the toner image can be controlled to be constant at the time of toner image formation by the image signal due to the above control.

FIG. 16(*c*) shows the third example in which image forming conditions are switched. In this example, the peripheral speed of the developing sleeve 141 is lowered from the number of revolutions N1 (rpm) at the time of previous image formation to the number of revolutions N2 (rpm) which is 2/7 of N1, that is, N2=(2/7)N1, and the respective patch images for yellow (Y), magenta (M), cyan (C) and black (BK) are formed.

When the peripheral speed of the sleeve is lowered, developing characteristics at the time of patch image formation can be obtained as shown in FIG. 16(*c*).

By the means described above, when the laser power (0.4 μJ/cm$^2$) is used in order to form the high density toner image, which is required for a solid image and characters, on the photoreceptor drum 10, the latent image having the potential voltage $V_L$ of −50 V is formed on the photoreceptor drum 10. The patch image to which toner of 0.2 mg/cm$^2$ is adhered is formed and the area in which the detection sensitivity of the patch detection unit 100 is high (the output voltage of approximately 4 V) is formed.

Under the above-described conditions, the following operations are conducted. The densities of respective patch images for yellow (Y), magenta (M), cyan (C) and black (BK) are detected and the control circuit 31 in FIG. 6(*a*) controls the developing sleeve driving circuit 34. It then adjusts the peripheral speed of each sleeve so that the toner adhesion amount of the patch image corresponding to each color toner can be a predetermined value, independently of variations of the characteristics of the photoreceptor drum and variations of developing characteristics.

Assuming that the peripheral speed of the sleeve after the adjustment is N2' (rpm). At the time of toner image formation by the image signal, the peripheral speed of the sleeve is always set to 7/2 of the adjusted peripheral speed N2' (rpm) of the sleeve at the time of patch image formation.

Since there is a proportional relationship between the peripheral speed of the sleeve and the toner adhesion amount, the toner adhesion amount of the toner image is controlled to be constant at the time of toner image formation by the image signal due to the above control.

Concerning comparison 1 in which the density of the patch image is detected without changing the peripheral speed of the sleeve and the developing bias voltage corresponding to the foregoing examples 1 and 2, and comparison 2 in which the density of the patch image is detected without lowering the peripheral speed of the sleeve to 2/7 of the prior speed corresponding to the foregoing example 3, the results in which printing tests of approximately one hundred thousand sheets have been conducted by the inventors is shown in Table 1 together with examples 1 to 3.

From this result, in examples 1 to 3 in which the patch image has been formed under image conditions which are different from normal image conditions, good detecting property and color stability of the patch image can be obtained. However, in comparison 1 and 2, the following is recognized. The detecting property of the patch image is bad and the stability of color tone and density are low.

Further, the charging voltage is adjusted by controlling the grid voltage power source 32 so that the toner adhesion amount of the patch image is controlled to be a predetermined value. However, the developing bias voltage power source 34 for yellow (Y), magenta (M), cyan (C) and black (BK) may be controlled so that respective developing bias voltage is adjusted. Alternatively, the developing sleeve driving circuit 34 may be controlled so that the peripheral speed of respective sleeves are adjusted.

In the foregoing examples 1, 2 and 3, the correction by yellow (Y), magenta (M), cyan (C) and black (BK) at the time of color image formation has been described, but the density can also be controlled in the same way at the time of monochrome image formation by only black (BK).

Initially, the correction of the difference of light reflection characteristics from the photoreceptor surface of the photoreceptor drum 10 (hereinafter, referred to as base line correction) will be explained below.

The image density detected from the patch image P also varies depending on light reflection characteristics of the photoreceptor surface of the photoreceptor drum 10 and the difference of the reflected light detection ability of the patch detection unit 100.

Although the photoreceptor surface of the photoreceptor drum 10 has a light absorption layer on the base body, the fluctuation of the thickness of this light absorption layer occurs depending on the product. Accordingly, some individual differences between reflection factors of the photoreceptor surface inevitably occur.

Figure 11:
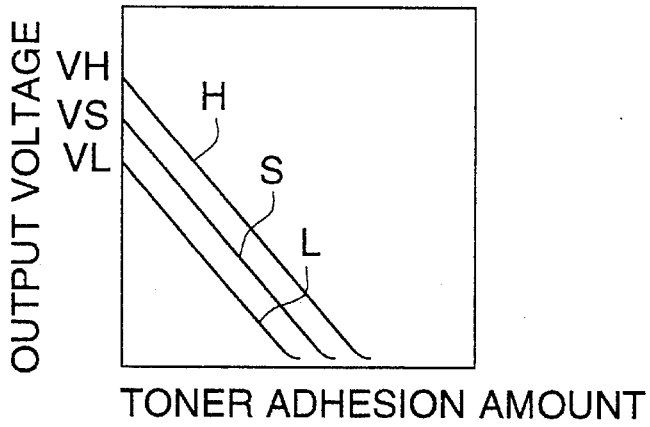
FIGS. 11(*a*), 11(*b*) and 11(*c*) are graphs showing changes of the output voltage of the patch detection unit accompanied with changes of conditions of the photoreceptor and the density detecting ability.
Figure 11:
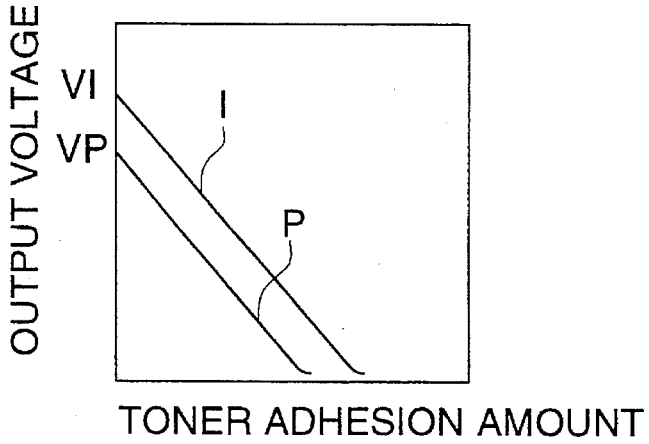
Figure 11:
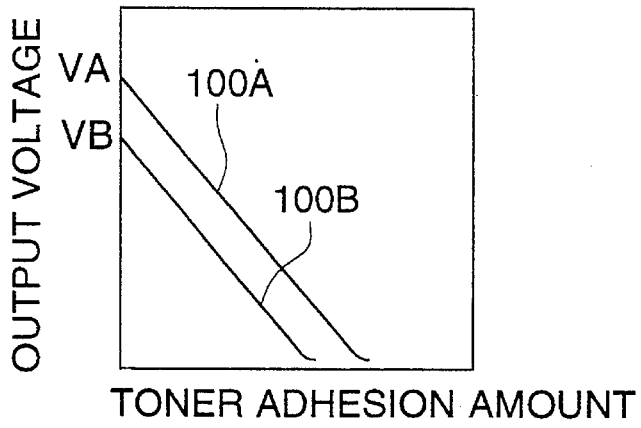

FIGS. 11(*a*), 11(*b*) and 11(*c*) show the change of output voltage from the detection circuit with respect to the toner adhesion amount of the photoreceptor surface. FIG. 11(*a*) shows the comparison of the change of output voltage $V_S$ with respect to the toner adhesion amount in the case where the photoreceptor S having a normal reflection factor is used and the changes of the output voltage $V_H$ and $V_L$ in the case where the photoreceptors H and L having the reflection factors near the normal reflection factor are used. In FIG. 11(*a*), the approximately constant difference is produced

TABLE 1

| | Process conditions | | | | | | | | |
|---|---|---|---|---|---|---|---|---|---|
| | At the time of patch formation | | | At the time of image formation | | | Copying test for 100,000 sheets | | |
| | Laser power (μw/cm²) | DC bias (V) | Number of rotations of developing sleeve (rpm) | Laser power (μw/cm²) | DC bias (V) | Number of rotations of developing sleeve (rpm) | Detection property of patch | Object to be controlled for constant patch voltage | Color stability |
| Example 1 | 0.4 | −750 | 80 | 0.4 | −750 | 280 | o | Grid voltage of charger | o |
| Example 2 | 0.4 | −250 | 280 | 0.4 | −750 | 280 | o | Grid voltage of charger | o |
| Example 3 | 0.4 | −750 | 2/7 N1 (Variable) | 0.4 | −750 | 7/2 N2' (Variable) | o | Peripheral speed of developing sleeve* | o |
| Comparative example 1 | 0.4 | −750 | 280 | 0.4 | −750 | 280 | x | Grid voltage of charger | x*** |
| Comparative example 2 | 0.4 | −750 | N2 (Variable) | 0.4 | −750 | N2' (Variable) | x | Peripheral speed of developing sleeve** | x*** |

*(ratio of peripheral speed at the time of patch formation and that at the time of image formation = 2/7 (constant))
**(peripheral speed at the time of patch formation is the same as that at the time of image formation)
*Density and color tone are largely changed In the present invention, the image density is adjusted as described above. Since the output voltage of the detection circuit 33 shown in FIG. 6**(*a*) varies due to the following reasons, it is preferable to conduct its correction.

The correction of the output voltage of the detection circuit 33 will be explained below.

For the correction of the output voltage of the detection circuit 33, the following two corrections can be considered. First, the correction of variations of light reflection characteristics from the photoreceptor surface of the photoreceptor drum 10. Second, the correction of the difference of the light transmission factors due to colors of toners.

Both of the above-described corrections may be conducted at the same time, or only one of them may be conducted.

between output voltages independently of the changes of toner adhesion amount.

The photoreceptor surface of the photoreceptor drum 10 is changed to the irregular reflection surface by an abrasion etc. caused by a long period of use, thus the reflection factor is gradually lowered. FIG. 11(*b*) shows the comparison of the change of the output voltage $V_I$ with respect to the toner-adhesion amount to the photoreceptor I at the start of use and the change of the output voltage $V_P$ with respect to the toner adhesion amount to the photoreceptor P after one hundred thousands of sheets have been printed. Also in this case, it is recognized that the approximately constant difference is produced between output voltages independently of the change of toner adhesion amount.

Further, even when a new photoreceptor drum 10 having the normal reflection factor is used, the output voltage from the detection circuit of the patch detection unit 100 is lowered in the case where toner and dusts adhere to a light emitting section and a light receiving section for a long period of use and the detection ability of the reflection light is lowered. FIG. 11(*c*) shows the comparison of the change of the output voltage $V_A$ with respect to the toner adhesion amount in the case where the toner adhesion amount is detected by a patch detection unit 100A which is under a clean condition and the change of the output voltage $V_B$ in the case where the toner adhesion amount is detected by the patch detection unit 100B in which the detection ability is lowered by printing approximately one hundred thousand sheets. Also in this case, it is recognized that the approximately constant difference is produced between output voltages independently of the change of toner adhesion amount.

In order to correct the deviation of the output voltage from the detection circuit caused by these factors in the present invention, the reflection factor of the photoreceptor of the new photoreceptor drum 10 is measured by the patch detection unit 100 under the condition in which toner is not adhered to the photoreceptor and the measured value is stored in a memory of a control logic circuit in advance. Next, the reflection factor of the photoreceptor is repeatedly measured under the condition in which toner is not adhered to the photoreceptor for every time when a predetermined number of sheets, for example, 100 sheets, have been copied, and the difference between the output voltages is computed at every time when a predetermined number of sheets have been copied. The base line of the output voltage from the detection circuit at the time when the patch image P is detected, is corrected by this difference of the output voltage. As a result, the fluctuation of the photoreceptor, noises and deviation accompanied with decrease of the detection ability of the patch detection unit 100 caused by a long period of use, are automatically corrected, and the accurate density detection of the patch image P and the accurate control of the image density based on the density detection can be realized.

Figure 12:
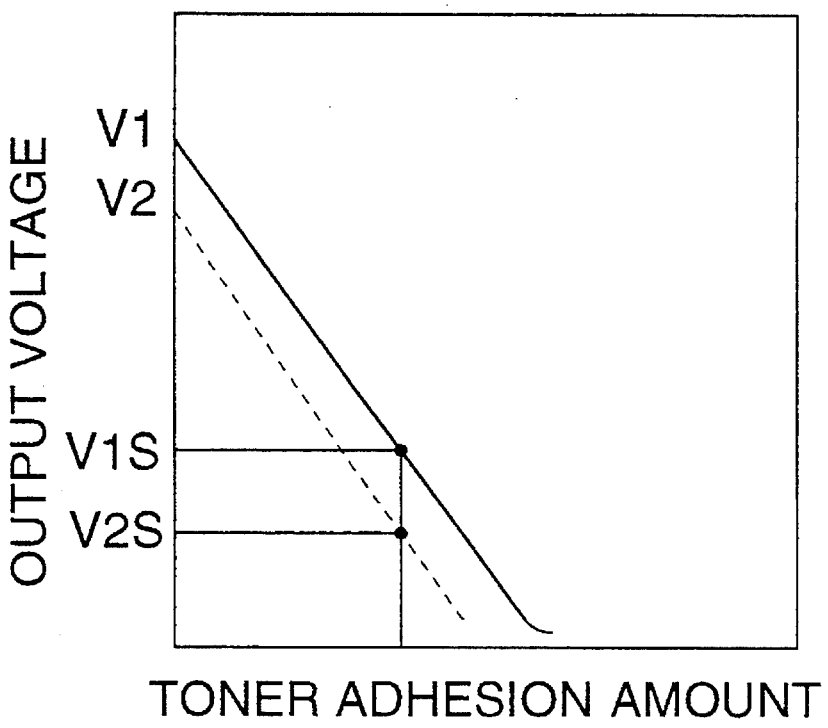
FIG. 12 is a graph showing a base line correction of the output voltage of the patch detection unit.

In FIG. 12, $V_1$ and $V_2$ show the output voltage according to the detection of the new photoreceptor surface under the condition of no toner adhesion and the output voltage according to the detection of the photoreceptor surface after a predetermined number of sheets have been printed. When the deviation of the output voltage ($V_1$–$V_2$) is added to the later output voltage V2S in the case where toner is adhered to the photoreceptor surface, the output voltage V1S corresponding to the case where the new photoreceptor surface is used can be obtained.

As described above, the deviation of the output voltage ($V_1$–$V_2$) obtained by the detection of the photoreceptor after printing is added to the output voltage $V_{2s}$ obtained in the case where toner is adhered to the photoreceptor surface. Instead of that, an amount of emitted light of the light emitting element of the detector can be increased corresponding to the above-described deviation of the output voltage ($V_1$–$V_2$).

Specifically, an amount of emitted light can be increased when the voltage impressed upon a light emitting element 102 shown in FIG. 6(*b*) is adjusted.

In this way, the correct density detection can be realized without correcting the output voltage of the detector.

When the case where the base line correction is conducted on the output voltage according to the density detection of the patch image P as shown in the example is compared with the case, (comparative example), in which no base line correction is conducted as in the conventional use, the following is recognized. As shown in Table 2, no problem is recognized in both cases in the initial stage of use. In the comparative example, the unbalance of color is recognized at the time when the number of printed sheets is fifty thousand, and the image density is lowered when the number of printed sheets is one hundred thousand. On the contrary, the following is recognized in the example. The image density keeps its quality as if in the initial stage of use. The color density is always satisfactory and the well-balanced color image can be obtained.

TABLE 2

| | Initial | 50,000 sheets printing | 100,000 sheets printing |
|---|---|---|---|
| Example (base line correction) | o | o | o |
| Comparative example (no correction) | o | Δ | x |

Next, the correction by the difference of the light transmission factor due to the color of toner will be described below. In the detection of the image density of the patch image P, it is preferable that the adhered toner of yellow (Y), magenta (M), cyan (C) and black (BK) is detected respectively by the wavelength having a small transmission factor.

Figure 13:
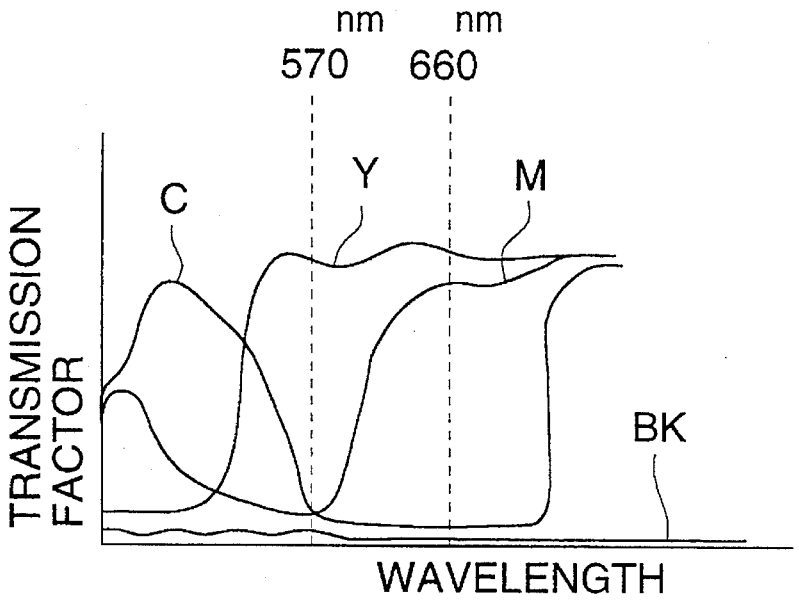
FIG. 13 is a graph showing the light transmission factor of each toner.

However, there is an occasional case in which the difference is produced between output voltages of the detection circuit 33 notwithstanding the same image density in the case where the density of each color patch image P is detected by the light having the constant wavelength, because the light transmission factors of respective toners are largely different depending on the wavelength areas as shown in FIG. 13.

In the present invention, considering the light transmission factor of toner, the difference due to color is set in advance to the amount of toner adhered to the patch image and the output voltage from the detection circuit 33 is controlled to be the same in the case of the same image density.

Figure 14:
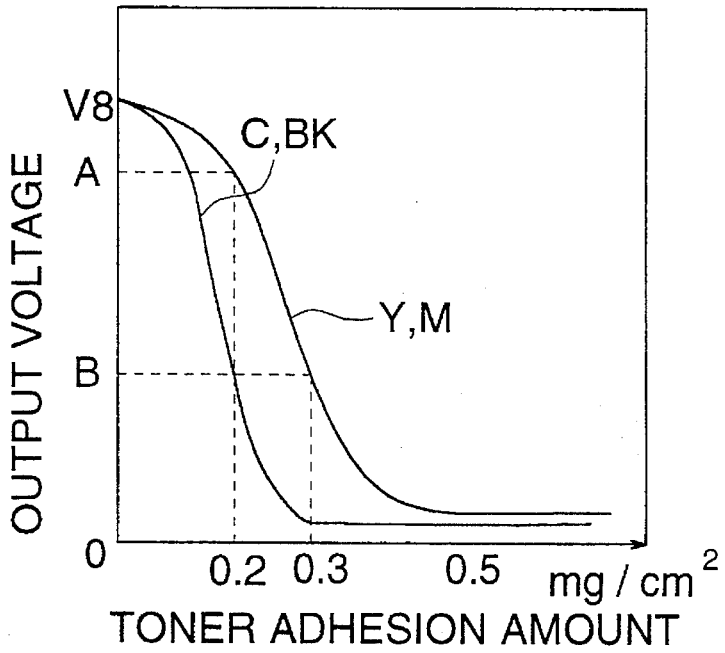
FIG. 14 is a graph showing the output voltage of the patch detection unit and the toner adhesion amount.

FIG. 14 shows the relationship between the toner adhesion amount and the output voltage in the patch image P corresponding to each color toner in the case where the LED having the wavelength of 660 nm is used in the light emitting section 101.

In FIG. 14, the same output voltage is generated in the case where the toner adhesion amount of yellow (Y) and magenta (M) is 0.3 mg/cm$^2$ and that of cyan (C) and black (BK) is 0.2 mg/cm$^2$.

Accordingly, the following can be conducted. The relationship of yellow (Y) and magenta (M), with cyan (C) and black (BK) is stored in the memory in advance. The output voltage is corrected in proportion to the foregoing relationship and the output voltage from the detection circuit 33 is controlled to be the same in the case of the same image density.

Specifically, in the case of the same toner adhesion amount of 0.2 mg/cm$^2$, the output voltage A due to yellow (Y) and magenta (M) and the output voltage B due to cyan (C) and black (BK) are corrected in the manner that two voltages are outputted as the same output voltage from the detection circuit 33. Further, it may be allowed that the foregoing correction is conducted in the control circuit 31.

Approximately 10,000 sheets have been copied in the same image forming apparatus, and the color stability of the image has been checked for each color by inventors in the case where the foregoing correction is conducted and in the case of no correction. As a result, the following is recognized. The stable color tone can be obtained for each color in the case where the correction is conducted and there is a tendency that any of the colors lacks in stability in the case of no correction.

Further, the influence due to the difference of the light transmission factor depending on the color of toner can also be corrected by the following method.

That is, the output voltage can be controlled in the following manner. Switching of the output of the image exposure means 13, the peripheral speed of the developing sleeve 141, the developing bias voltage or charging voltage is adjusted corresponding to the difference of the toner adhesion amount as shown in FIG. 14 in the case where the patch images of yellow (Y) and magenta (M) are formed, and in the case where the patch images of cyan (C) and black (BK) are formed; and the output voltage from the detection circuit 33 is controlled to be the same in the case of the same image density, independently of the color of toner.

The case where the LED of the wavelength of 660 nm is used has been explained in the foregoing example. However, in the case where the LED of the wavelength of 570 nm is used, yellow (Y) is distinguished from magenta (M), cyan (C) and black (BK) as shown in FIG. 13, and the output voltage from the detection circuit 33 may be corrected to be the same in the case of the same image density.

According to the present invention, the density of the patch image by the exposure amount, by which the high density toner image required for a solid image and characters is formed, can be detected highly sensitively, and the color image forming apparatus can be provided by which a color image having high color stability can be always obtained.

The color density adjustment in the digital type color image forming apparatus has been explained in this example. However, the present invention can also be applied to an analog type color image forming apparatus or a monochrome image forming apparatus, and is very effective for forming the image having superior color tone and gradation.

What is claimed is:

1. An image forming apparatus, comprising:

an image retainer;

a charger for electrically charging the image retainer;

a latent image former for forming a latent image of a recording image corresponding to image information on the charged image retainer;

a developer for developing the latent image of the recording image so as to form a toner image of the recording image, the developer including a developing sleeve by which developer is conveyed onto the image retainer;

an electric bias for applying a developing bias voltage to the developer;

a control for controlling the charger, the latent image former, the developer and the electric bias so as to form a patch image used as a test image on the image retainer under a patch image forming condition which is different from a recording image forming condition under which the toner image of the recording image is formed;

an optical detector for detecting a density of the patch image and generating a detection output; and the control controlling at least one of the charger; the developer and the electric bias in accordance with the detection output of the optical detector so that a density of the toner image of the recording image formed on the image retainer satisfies a predetermined condition, the control adjusting a peripheral speed of the developing sleeve of the developer during formation of the patch image to be different from that during formation of the recording image.

2. An image forming apparatus, comprising:

an image retainer;

a charger for electrically charging the image retainer;

a latent image former for forming a latent image of a recording image corresponding to image information on the charged image retainer;

a developer for developing the latent image of the recording image so as to form a toner image of the recording image, the developer including a developing sleeve by which developer is conveyed onto the image retainer;

an electric bias for applying a developing bias voltage to the developer;

a control for controlling the charger, the latent image former, the developer and the electric bias so as to form a patch image used as a test image on the image retainer under a patch image forming condition which is different from a recording image forming condition under which the toner image of the recording image is formed;

an optical detector for detecting a density of the patch image and generating a detection output; and the control controlling at least one of the charger; the developer and the electric bias in accordance with the detection output of the optical detector so that a density of the toner image of the recording image formed on the image retainer satisfies a predetermined condition, a device for correcting the detection output of the optical detector on the basis of a reflecting ratio of a surface of the image retainer.

3. The apparatus of claim 2 wherein the control adjusts the developing bias voltage during formation of the patch image to be different from that during formation of the recording image.

4. A color image forming apparatus, comprising:

an image retainer;

a charger for electrically charging the image retainer;

a latent image former for forming a latent image of a recording image corresponding to image information on the charged image retainer;

a plurality of developing devices for developing the latent image of the recording image with developers differing in color from each other so as to form a color toner image of the recording image, each of the plurality of developing devices including a developing sleeve by which the developer is conveyed onto the image retainer;

an electric bias for applying a developing bias voltage to the plurality of developing devices;

a control for controlling the charger, the latent image former, the plurality of developing devices, and the electric bias so as to form a plurality of patch images corresponding to the plurality of developing devices on the image retainer under a patch image forming condition which is different from a recording image forming condition under which the toner image of the recording image is formed;

an optical detector for detecting a density of each of the plurality of patch images and generating detection outputs; and the control controlling at least one of the charger, the plurality of developing devices, and the electric bias in accordance with the detection outputs of the optical detector so that a density of the color toner image of the recording image formed on the image retainer satisfies a predetermined condition, the control adjusting a peripheral speed of the developing sleeve of the plurality of developing devices during formation of the plurality of patch images to be different from that during the formation of the recording image.

5. A color image forming apparatus, comprising:

an image retainer;

a charger for electrically charging the image retainer;

a latent image former for forming a latent image of a recording image corresponding to image formation on the charged image retainer;

a plurality of developing devices for developing the latent image of the recording image with developers differing in color from each other so as to form a color toner image of the recording image, each of the plurality of developing devices including a developing sleeve by which the developer is conveyed onto the image retainer;

an electric bias for applying a developing bias voltage to the plurality of developing devices;

a control for controlling the charger, the latent image former, the plurality of developing devices, and the electric bias so as to form a plurality of patch images corresponding to the plurality of developing devices on the image retainer under a patch image forming condition which is different from a recording image forming condition under which the toner image of the recording image is formed;

an optical detector for detecting a density of each of the plurality of patch images and generating detection outputs; and the control controlling at least one of the charger, the plurality of developing devices, and the electric bias in accordance with the detection outputs of the optical detector so that a density of the color toner image of the recording image formed on the image retainer satisfies a predetermined condition, a correction device for correcting the detection output of the optical detector on the basis of a reflecting ratio of a surface of the image retainer.

6. The apparatus of claim 5 wherein the control adjusts the developing bias voltage during formation of the plurality of patch images to be different from that during the formation of the recording image.

7. The apparatus of claim 5 comprising a correction device for correcting the detection output of the optical detector on the basis of a color of the toner forming the corresponding patch image.

8. The apparatus of claim 5 wherein the control changes the test image forming condition in accordance with a color of the toner forming the corresponding patch image.

* * * * *